US008075210B2

(12) United States Patent
Yokoyama

(10) Patent No.: US 8,075,210 B2
(45) Date of Patent: Dec. 13, 2011

(54) DEVICE FOR PRODUCING TAGS FOR PATIENT WRISTBANDS, A SYSTEM FOR PRODUCING TAGS FOR PATIENT WRISTBANDS, AND A PRINT MEDIUM

(75) Inventor: Kazuyuki Yokoyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 908 days.

(21) Appl. No.: 11/655,474

(22) Filed: Jan. 18, 2007

(65) Prior Publication Data

US 2007/0172291 A1 Jul. 26, 2007

(30) Foreign Application Priority Data

Jan. 19, 2006 (JP) ..... 2006-011392

(51) Int. Cl.

| | |
|---|---|
| ***B41J 11/70*** | (2006.01) |
| ***B41J 29/38*** | (2006.01) |
| ***A41D 20/00*** | (2006.01) |
| ***G09F 3/00*** | (2006.01) |

(52) U.S. Cl. ..... 400/621; 400/76; 40/633; 283/75

(58) Field of Classification Search ..... 400/621; 40/633, 674; 283/900

See application file for complete search history.

(56) References Cited

U.S. PATENT DOCUMENTS

| | | | | | |
|---|---|---|---|---|---|
| 2,911,743 | A | * | 11/1959 | Pokras | 40/633 |
| 2,954,620 | A | * | 10/1960 | Schneider | 40/633 |
| 3,106,028 | A | * | 10/1963 | Baumgartner | 40/633 |
| 4,110,502 | A | * | 8/1978 | Baer | 428/42.1 |
| 4,311,740 | A | * | 1/1982 | Kay | 428/43 |
| 5,144,891 | A | * | 9/1992 | McKenna | 101/227 |
| 5,792,299 | A | * | 8/1998 | Mosher, Jr. | 156/230 |
| 2007/0028495 | A1 | * | 2/2007 | Kotik et al. | 40/633 |
| 2007/0034103 | A1 | * | 2/2007 | Kaufman | 101/483 |

FOREIGN PATENT DOCUMENTS

| | | | | |
|---|---|---|---|---|
| EP | 702343 | A1 | * | 3/1996 |
| GB | 2228915 | A | * | 9/1990 |
| JP | 62116472 | A | * | 5/1987 |
| JP | 07034366 | A | * | 2/1995 |
| JP | 11174963 | A | * | 7/1999 |
| JP | 2001096649 | A | * | 4/2001 |
| JP | 2001-137017 | | | 5/2001 |
| JP | 2001-316921 | | | 11/2001 |
| JP | 2005195633 | A | * | 7/2005 |
| WO | WO 2004103713 | A1 | * | 12/2004 |

* cited by examiner

*Primary Examiner* — Daniel J Colilla

(74) *Attorney, Agent, or Firm* — Nutter McClennen & Fish LLP; Jerry J. Penny, Jr.; Rory P. Pheiffer

(57) ABSTRACT

A patient wristband tag production apparatus for printing and producing a tag precursor that includes a printing unit, a print medium web, an information acquisition unit, a printing control unit, and a cutter. The print medium web can have a perforation running along a length of the web and dividing the web into a tag printing area and an insertion tab area, the web being configured to produce tag precursors. The tag precursors produced from the web can have a printed tag part formed from the tag printing area on which patient identification information is printed such that the tag precursor is configured to be stored in a tag storage part of a patient wristband, and an insertion tab part formed from the insertion tab area that is detachably connected to the printed tag part and is configured to be used for inserting the printed tag part into the tag storage part.

33 Claims, 11 Drawing Sheets

| NAME | ID | ADDRESS | TEL | DOB | DEPARTMENT | BUILDING | ATTENDING PHYSICIAN | BLOOD TYPE | ALLERGIES |
|---|---|---|---|---|---|---|---|---|---|
| ○○○○ | 012345 | TOKYO-TO, CHIYODA-KU | 03-1234- | 1923.12.13 | INTERNAL MEDICINE | ANNEX A | ○×○× | B | NONE |
| △△△△ | 023456 | KANAGAWA-KEN, YOKOHAMA-SHI | 045-9876 | 1997.05.05 | PEDIATRICS | ANNEX C | △○△○ | O | EGGS |
| ×××× | 034567 | TOKYO-TO, EDOGAWA-KU | 03-5237- | 1957.09.19 | INTERNAL MEDICINE | ANNEX A | ○×○× | AB | NONE |
| □□□□ | 045678 | TOKYO-TO, NAKANO-KU | 03-3319- | 1983.03.03 | INTERNAL MEDICINE | ANNEX A | ○△□× | A | NONE |
| ◇◇◇◇ | 056789 | CHIBA-KEN, ICHIKAWA-SHI | 042-8386 | 1980.06.12 | SURGERY | ANNEX B | □○□○ | AB | NONE |
| ▽▽▽▽ | 067890 | TOKYO-TO, SHINJUKU-KU | 03-5519- | 1971.10.02 | SURGERY | ANNEX B | □○□○ | B | NONE |

FIG. 3

DEVICE FOR PRODUCING TAGS FOR PATIENT WRISTBANDS, A SYSTEM FOR PRODUCING TAGS FOR PATIENT WRISTBANDS, AND A PRINT MEDIUM

This application claims benefit from Japanese Patent Application JP 2006-011392, filed on Jan. 19, 2006, which is hereby incorporated by reference in its entirety.

BACKGROUND OF THE INVENTION

1. Field of Invention

The present invention relates to a device for producing tags on which patient identification information such as the patient name, patient identification number, and patient blood type is printed and which are inserted to the tag holding part of a patient wristband, to a system for producing such tags, and to a print medium used for printing such tags.

2. Description of Related Art

Patient wristbands (medical wristbands) that have a display part on which patient identification information is written and a band that is wrapped around the patient's wrist or ankle are used in hospitals, for example, to identify each patient and help prevent medical errors. See, for example, Japanese Unexamined Patent Appl. Pub. JP-A-2001-137017.

When the patient identification information is written or printed directly on the patient wristband, the printed portion can be easily soiled or damaged, and if a printing error occurs the entire wristband is wasted. One way to prevent such problems is to use a transparent wristband with a tag storage unit (pocket) for holding the tag printed with the patient identification information so that the information is visible from outside the pocket. The printed tag is then inserted to this pocket and the pocket is then closed and sealed with the tag inside.

So that the outside end of the tag is not exposed from the insertion opening to the pocket, the tag must be inserted all the way into the pocket. However, the opening to the tag pocket is sized to match the tag, the opening is therefore tight and inserting the tag to the pocket can be difficult. As a result, some people are unable to insert the tag all the way into the pocket without using tweezers, for example.

The invention provides a device for producing tags that can be easily inserted all the way into the tag pocket of a patient wristband having a tag pocket, a system for producing tags for patient wristbands, and a print medium used to print the tags.

SUMMARY OF THE INVENTION

A patient wristband tag production apparatus according to a preferred aspect of at least one embodiment of the invention prints and produces tag precursors using a print medium web. Each tag precursor has a printed tag part on which patient identification information is printed and which is stored in a tag storage part of a patient wristband, and an insertion tab part that is detachably connected to the printed tag part and is used for inserting the printed tag part into the tag storage part. The width of the print medium web is divided by a perforation running the length of the web into a tag printing area that becomes the printed tag part and an insertion tab area that becomes the insertion tab part. The patient wristband tag production apparatus has a printing unit; an information acquisition unit for acquiring the patient identification information; a printing control unit for printing the acquired patient identification information in the tag printing area while advancing the print medium; and a cutter for cutting across the print medium width to sever the portion of the print medium printed by the printing unit as the tag precursor.

This aspect of the invention produces tags with an insertion tab. More specifically, this aspect of the invention produces tag precursors having a printed tag part on which patient identification information is printed, and an insertion tab part that is contiguous to the printed tag part, can be separated from the printed tag part by a perforation, and can be torn away from the printed tag part at the perforation after being used to insert the printed tag part to the tag storage part (pocket) of the wristband. The insertion tab part can therefore be held between the fingers to insert the printed tag part to the pocket of the patient wristband without the fingers that are holding the insertion tab part catching on the opening to the pocket, and the printed tag part can be easily inserted all the way into the pocket. After insertion the printed tag part is held firmly in one hand while the insertion tab part sticking out from the pocket is torn off at the perforation by the other hand, leaving only the printed tag part as a tag inside the tag storage part (pocket) of the wristband.

Because the tag precursors are produced by cutting across the width of the print medium web with a cutter after the tag portion is printed, as many tags as needed can be easily and conveniently printed and produced. More specifically, if the tag precursors are produced without using a cutter, the print medium must have a grid of perforations running lengthwise and widthwise so that the printed tag precursors can be separated from the unprinted medium. In a typical hospital where the number of patients admitted at any one time is not large, the number of tag precursors required at any one time may be as few as one and is typically less than a full sheet, and a complete sheet is not used at any one time. If only one tag precursor is printed, for example, the paper must be advanced after printing so that the printed tag can be separated at the perforation, and the paper must then be reversed after the printed tag is torn off. This easily results in misalignment of the printing position in the sheet feeding direction when the next tag is printed, and results in the next tag precursor being printed on both sides of the perforation between two adjacent tags.

If tag precursors of different sizes are printed, printing stock must also be available for each different size of tag. Furthermore, because the tags are printed and torn off in units of less than a full sheet at one time, it is difficult to print appropriately to the remaining part of the sheet. If perforated sheets are used, either the unused portion of a partially printed sheet is thrown away or the patient identification information is handwritten on the remain tags, and this is inconvenient and error prone. Alignment errors also occur easily when single sheet media is used, and a single tag may be printed across the perforation separating two tags.

If a paper cutter is used as in this invention, however, the print medium can be cut at the desired lengthwise position and a single print medium can be used to print tags of different sizes with no alignment errors or media waste.

A patient wristband tag production apparatus according to another aspect of the invention selectively prints and produces first information tag precursors and second information tag precursors using a print medium web. Each first information tag precursor and second information tag precursor having a printed tag part on which patient identification information is printed and which is stored in a tag storage part of a patient wristband, and an insertion tab part that is detachably connected to the printed tag part and is used for inserting the printed tag part into the tag storage part. The width of the print medium web is divided by a first perforation running the length of the web into a first tag printing area that becomes the printed tag part of the first information tag precursor and a first insertion tab area that becomes the insertion tab part of the first information tag precursor, and is divided by a second perforation running the length of the web into a second tag printing area that becomes the printed tag part of the second information tag precursor and a second insertion tab area that becomes the insertion tab part of the second information tag precursor. The patient wristband tag production apparatus has a printing unit; an information acquisition unit for acquiring the patient identification information as the first information or the second information; a printing control unit for printing the first information in the first tag printing area while advancing the print medium when the first information is acquired, and printing the second information in the second tag printing area while advancing the print medium when the second information is acquired; and a cutter for cutting across the print medium width to sever the portion of the print medium printed by the printing unit as the first information tag precursor or the second information tag precursor.

This aspect of the invention uses a single print medium to selectively produce first information tag precursors and second information tag precursors. More specifically, when the first information is acquired, the first information is printed in the first tag printing area to produce a first information tag precursor having a printed tag part where the first information is printed and an insertion tab part that is contiguous to and can be separated from the printed tag part by means of the first perforation. When the second information is acquired, the second information is printed in the second tag printing area to produce a second information tag precursor having a printed tag part where the second information is printed and an insertion tab part that is contiguous to and can be separated from the printed tag part by means of the second perforation. Two types of print media, specifically print media for producing the first information tag precursors and print media for producing the second information tag precursors, are therefore not needed to produce tag precursors of different sizes, for example, and it is not necessary to change the print medium in order to produce different types of tags.

Furthermore, the insertion tab part of the first information tag precursor can be held in the fingers to insert the printed tag part in the tag storage part (pocket) of a first information wristband, and the printed tag part can be easily inserted all the way into the tag pocket without the fingers that are holding the insertion tab part catching on the opening to the pocket. The inserted printed tag part can then be held firmly in one hand while the insertion tab part is torn off at the first perforation so that only the printed tag part is left as the tag in the wristband pocket. The insertion tab part of the second information tag precursor can likewise be held in the fingers to insert the printed tag part in the tag storage part (pocket) of a second information wristband, and the printed tag part can be easily inserted all the way into the tag pocket without the fingers that are holding the insertion tab part catching on the opening to the pocket. The inserted printed tag part can then be held firmly in one hand while the insertion tab part is torn off at the second perforation so that only the printed tag part is left as the tag in the wristband pocket.

The first tag printing area and the second tag printing area are also preferably printed offset to different sides of the paper width.

In this case, the first information is printed on both sides of the second perforation, and the second information is printed on both sides of the first perforation. On the other hand, if the first tag printing area and second tag printing area are on the same side of the paper width, the first information is printed on both sides of the second perforation but the second information is printed on only one side of the second perforation (when the first tag printing area is larger than the second tag printing area). Therefore, if the width of the second tag printing area is greater than half the full width of the print medium, the gap between the first perforation and the second perforation is greater than if the first tag printing area and second tag printing area are located at the same widthwise side of the print medium. It is therefore possible to prevent accidentally tearing of the printed tag part in two at the other perforation when the insertion tab part is torn off at one perforation after inserting the tag precursor to the tag pocket.

Further preferably, the printing control unit prints the second information with the top and bottom rotated approximately 180 degrees to the first information.

This arrangement enables holding the insertion tab parts to insert the printed tag parts of the first information tag precursor and second information tag precursor to the wristband pocket so that the tops and bottoms of the first information and second information are not opposite from each other when the tags are used in the wristbands. More specifically, by rendering the first tag printing area and second tag printing area on opposite sides of the paper width, the side where the first insertion tab area connects to the first tag printing area and the side where the second insertion tab area connects to the second tag printing area are opposite to each other. If the second information is then printed in the same orientation as the first information, the tops and bottoms of the first information and second information will be reversed when the printed tag part is inserted to the tag pocket by holding the insertion tab part. This aspect of the invention prevents this by reversing the printing orientation of the first and second information.

If the tag storage unit (pocket) has an insertion opening on both ends in the tag insertion direction so that the printed tag part can be inserted from either direction, the second information can be printed in the same direction as the first information even if the first tag printing area and second tag printing area are on different sides of the paper width. This is because the first information tag precursor can be inserted to the tag pocket from the insertion opening on one end and the second information tag precursor can be inserted to the tag pocket from the insertion opening on the other end.

In another aspect of the invention, the print medium is rendered so that the size of the first tag printing area measured across the paper width is different from the size of the second tag printing area measured across the paper width.

In this case, the first information is preferably patient identification information for adult patients and the second information is patient identification information for child patients.

This aspect of the invention enables selectively producing an adult patient tag precursor when the patient is an adult and a child patient tag precursor when the patient is a child using a single print medium.

Because of differences in body size, the tags for adult patients are generally large and the tags for child patients are small. As a result, the size of the first tag printing area that is used for adult patients is longer when measured across the paper width than the size of the second tag printing area that is used for child patients. Of course if the tags for child patients are large and the tags for adult patients are small, this correlation is reversed and the width of the second tag printing area is longer than the width of the first tag printing area.

A patient wristband tag production system according to another aspect of the invention includes the patient wristband tag production apparatus of the invention and an information supplying means that is linked to the patient wristband tag production apparatus and supplies the patient identification information to the information acquisition unit.

The information supplying means in this system supplies the patient identification information that is used to produce the tag precursors having a printed tag part on which the supplied patient identification information is printed and an insertion tab part. The patient identification information can thus be provided by the information supplying means to produce a tag precursor that can be easily inserted all the way into the tag storage unit (pocket) of the patient wristband.

Another aspect of the invention is the print medium used in the patient wristband tag production apparatus of the invention.

The print medium can thus be supplied to the patient wristband tag production apparatus of the invention to produce tag precursors that can be easily inserted all the way into the tag storage unit (pocket) of the patient wristband.

Another aspect of the invention is a patient wristband tag production method having steps of printing a tag precursor using a print medium web by means of a printing unit, acquiring the patient identification information by means of an information acquisition unit, printing the acquired patient identification information in the tag printing area while advancing the print medium by means of a printing control unit, and cutting the print medium across the paper width by means of a cutter. The tag precursor has a printed tag part that is stored in a tag storage part of a patient wristband, and an insertion tab part that is detachably connected to the printed tag part and is used for inserting the printed tag part into the tag storage part. The width of the print medium web is divided by a perforation running the length of the web into a tag printing area that becomes the printed tag part and an insertion tab area that becomes the insertion tab part.

A patient wristband tag production method according to another aspect of the invention has steps of printing a first information tag precursor and a second information tag precursor using a print medium web, acquiring the patient identification information as the first information or the second information by means of an information acquisition unit, printing the first information in the first tag printing area while advancing the print medium when the first information is acquired and printing the second information in the second tag printing area while advancing the print medium when the second information is acquired by means of a printing control unit, and cutting the print medium across the paper width by means of a cutter. Each first information tag precursor and second information tag precursor has a printed tag part that is stored in a tag storage part of a patient wristband, and an insertion tab part that is detachably connected to the printed tag part and is used for inserting the printed tag part into the tag storage part. The width of the print medium web is divided by a first perforation running the length of the web into a first tag printing area that becomes the printed tag part of the first information tag precursor and a first insertion tab area that becomes the insertion tab part of the first information tag precursor, and is divided by a second perforation running the length of the web into a second tag printing area that becomes the printed tag part of the second information tag precursor and a second insertion tab area that becomes the insertion tab part of the second information tag precursor.

Yet further preferably, the first tag printing area and the second tag printing area are printed offset to different sides of the paper width by the printing control unit.

In another aspect of the invention the second information is printed with the top and bottom rotated approximately 180 degrees to the first information by the printing control unit.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 3 shows an exemplary table of patient information.

DESCRIPTION OF THE PREFERRED EMBODIMENTS

Preferred embodiments of the roll paper (print medium) and patient wristband tag production system according to the present invention are described below with reference to the accompanying figures. This patient wristband tag production system uses roll paper to produce tag precursors having a printed tag part, on which patient identification information such as the patient name is printed and which is inserted to and kept in the tag holding part ("tag pocket" below) of the patient wristband, and an insertion tab part for inserting the printed tag part to the tag pocket. The patient wristband to which the printed tag part is inserted is described first below.

Figure 1A:
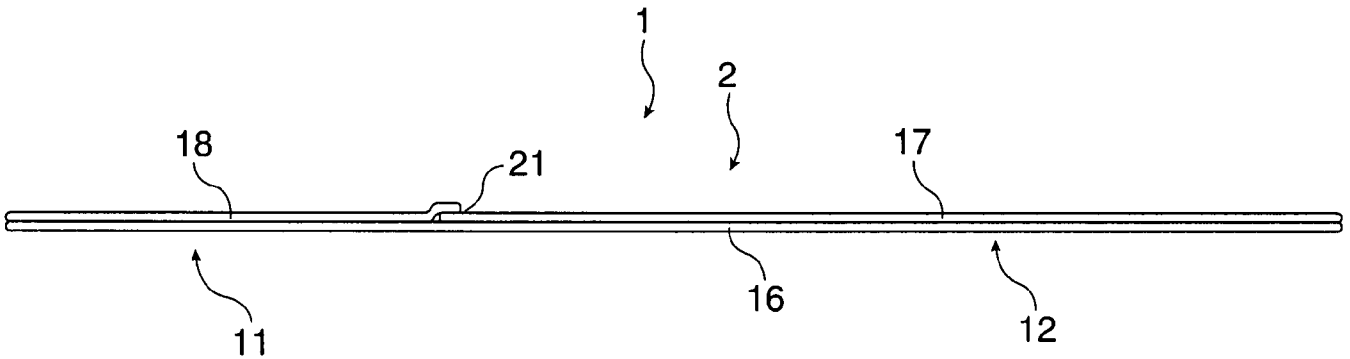
FIG. 1A shows a patient wristband from the side.
Figure 1B:
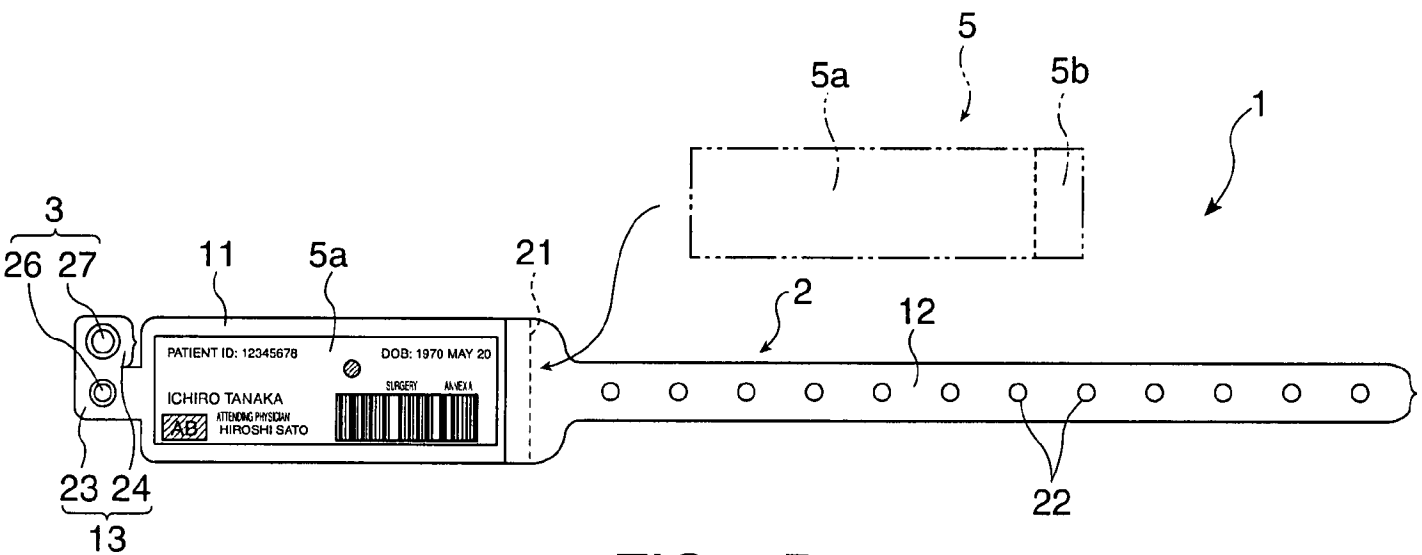
FIG. 1B is a plan view of the patient wristband with a tag precursor inserted in the pocket.

As shown in FIG. 1A and FIG. 1B a patient wristband 1 displays patient identification information in order to prevent patient identification errors, and has a wrist strap 2 and a fastening means such as a snap 3 located at one end of the wrist strap 2 for fastening the two ends of the wrist strap 2 together. The wrist strap 2 includes a tag holding part (referred to as a "tag pocket" hereinafter) 11 for holding the printed tag part 5*a* (described further below) on which patient identification information is printed. The wrist strap 2 is wrapped and permanently secured in a ring around the patient's wrist or ankle, for example, by the snap 3.

As described in further detail below, the tag precursor 5 has a printed tag part 5*a* and a insertion tab part 5*b*. The patient identification information printed on the printed tag part 5*a* may include the patient name, patient identification number, date of birth, hospital department, hospital building, attending physician name, blood type, a food allergy mark, and a barcode based on the patient ID number.

The wrist strap 2 includes the tag pocket 11, a belt 12 continuing from one end of the tag pocket 11, and a strap fastener 13 that continues from the other end of the tag pocket 11 and includes the stud 26 and socket 27 of the snap 3.

The wrist strap 2 has a transparent top sheet 16 that is exposed to the outside (the side that is visible when the wrist strap 2 is on the patient's wrist), a belt backing sheet 17 that covers the underside (back) of the belt 12 and the belt 12 end side of the tag pocket 11, and an opaque pocket backing sheet 18 covering the underside of the tag pocket 11 and strap fastener 13. The top sheet 16, belt backing sheet 17, and pocket backing sheet 18 are layered together and welded around the outside edges of the wrist strap 2. The top sheet 16 and pocket backing sheet 18 render the pocket-like tag holding part 11.

The printed tag part 5*a* stored in the tag pocket 11 is visible from the outside because the top sheet 16 is transparent, and the barcode (described further below) printed on the printed tag part 5*a* can be optically read using a barcode reader. Both sheets disposed on the underside of the wrist strap 2 can also be transparent. The sheets used in the wrist strap 2 are preferably waterproof and made from a medically safe polyurethane or other material.

The belt 12 side end of the pocket backing sheet 18 overlaps the back of the tag pocket 11 side end of the belt backing sheet 17, and this overlapping part is the insertion opening 21 to the tag pocket 11. The insertion opening 21 can thus be easily opened to insert the printed tag part 5*a*, and once inserted, the printed tag part 5*a* is prevented from accidentally falling out of the tag pocket 11. More specifically, while the belt 12 side end of the pocket backing sheet 18 forming the insertion opening 21 can be easily separated from the top sheet 16, the belt backing sheet 17 prevents the printed tag part 5*a* from accidentally falling out from the insertion opening 21. The insertion opening 21 can also be heat sealed so that the tag pocket 11 is watertight when the patient wristband 1 is used.

A series of holes 22 is formed along the length of the belt 12 so that the position where the snap 3 is closed can be adjusted according to the size of the patient's wrist. More specifically, the belt 12 is secured by the strap fastener 13 with the stud 26 of the strap fastener 13 passing through one of the holes 22. The remaining unneeded portion of the belt 12 can be cut off with scissors.

The strap fastener 13 has a stud-holding part 23 and a socket-holding part 24. The stud-holding part 23 is contiguous to the end of the tag pocket 11 and has attached thereto the stud 26 part of the snap 3. The socket-holding part 24 is contiguous to the stud-holding part 23, has the socket 27 part of the snap 3 attached thereto, and can be freely folded back to the stud-holding part 23.

The snap 3 includes the stud 26 affixed to the stud-holding part 23 of the strap fastener 13, and the socket 27 that is affixed to the socket-holding part 24 and receives the stud 26 from the open side. Though not shown in the figures, the stud 26 more specifically has a lip formed around the distal end of the stud, and the socket 27 has a receiver hole that prevents the stud 26 from leaving once the stud 26 is inserted into the socket 27.

After inserting the printed tag part 5*a* to the tag pocket 11, the patient wristband 1 is wrapped around the patient's wrist with the outside (the top sheet 16 side) of the wristband visible. The stud 26 is then passed through the desired hole 22 in the belt 12, the socket-holding part 24 is folded back to the stud-holding part 23 of the strap fastener 13 (so that the top of the socket-holding part 24 is no longer visible), and the stud 26 is snapped into the socket 27 to hold the patient wristband 1 permanently on the patient's wrist. To remove the patient wristband 1 when the patient leaves the hospital, the belt 12 can be simply cut with scissors.

The patient wristband tag production system 31 (simply "tag production system" below) for producing the tag precursor 5 composed of the printed tag part 5*a* and insertion tab part 5*b* is described next below with reference to FIG. 2 to FIGS. 6A-6C.

Figure 2:
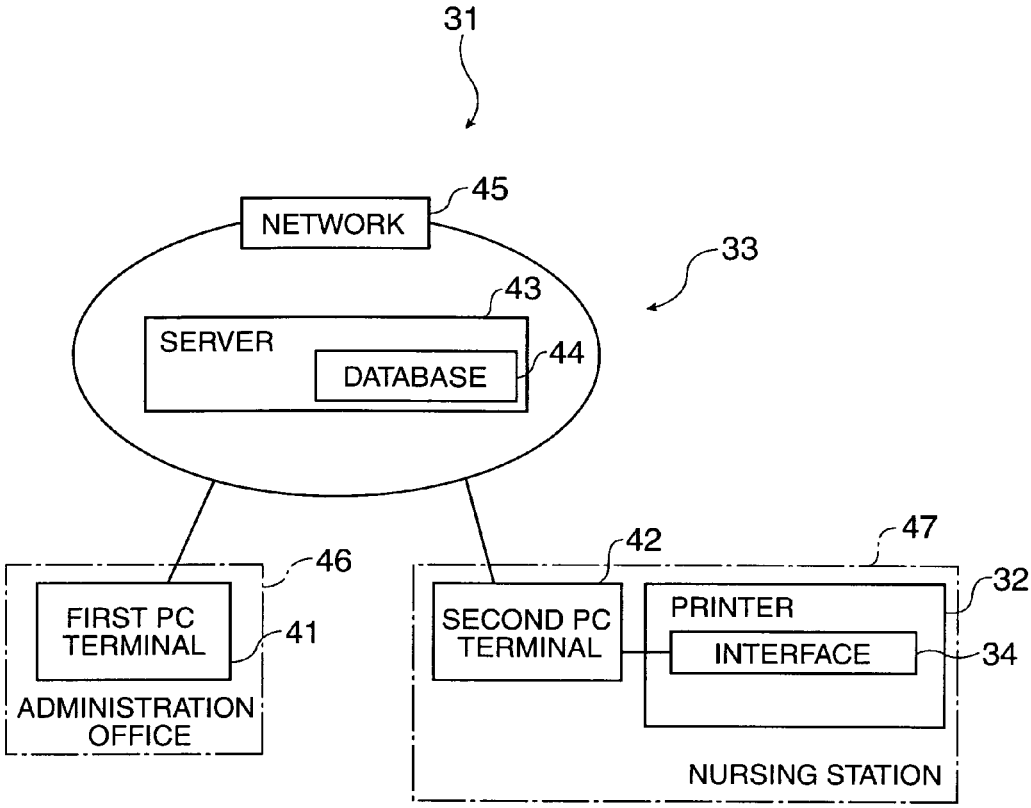
FIG. 2 is a block diagram of a system for producing tags for patient wristband according to the present invention.

As shown in FIG. 2, the tag production system 31 has a printer 32 (patient wristband tag production device) for printing on roll paper 50 while advancing the roll paper 50 from a roll paper compartment (see FIG. 5), and a data storage system 33 for providing the patient identification information to the printer 32. More specifically, the printer 32 has an interface 34 (data acquisition unit) for acquiring the patient identification information from the data storage system 33, and stores the patient identification information acquired through the interface 34 to a print buffer, for example. The printer 32 and one of a plurality of personal computer terminals (second PC terminal 42) are located at a nursing station 47 in the hospital. Note that while the printer 32 gets the patient identification information from an external source in this embodiment of the invention, data input from a local input unit (such as a keyboard) could be processed by a print control unit having a CPU and memory to acquire the patient identification information. In this case a display for confirming the input data is preferably also disposed to the printer 32.

The data storage system 33 is composed of a first PC terminal 41 located in a hospital administration office 46, the second PC terminal 42 located at the nursing station 47, and a server 43 that stores a database 44 containing patient information for each hospital patient and is connected over a network 45 to the two PC terminals 41 and 42.

A hospital employee enters patient information for each hospital patient using the first PC terminal 41, and the patient information is thus sequentially stored in the database 44 of the server 43. A nurse uses the second PC terminal 42 to search the database 44 for the patient for whom a tag precursor 5 is required to get the patient information, and the patient identification information derived from the patient information is then passed to the printer 32. The data storage system 33 could also be a stand-alone personal computer. In this case the patient information is entered in the personal computer connected directly to the printer 32 using a keyboard or removable storage media such as a floppy disk, and the patient identification information generated from the patient information is supplied to the printer 32.

As shown in FIG. 3 the patient information entered for each patient from the first PC terminal 41 using a keyboard or other input device includes the patient name, address, telephone number, patient ID number, date of birth, hospital department, hospital building, attending physician, blood type, and any food allergies, and each patient record is stored in the database 44.

The second PC terminal 42 generates the print data based on specific information (the patient name, patient ID number, date of birth, hospital building, attending physician, blood type, and food allergies) to be printed on the printed tag part 5*a* from the located patient information, and supplies this print data as the patient identification information to the printer 32.

Figure 4:
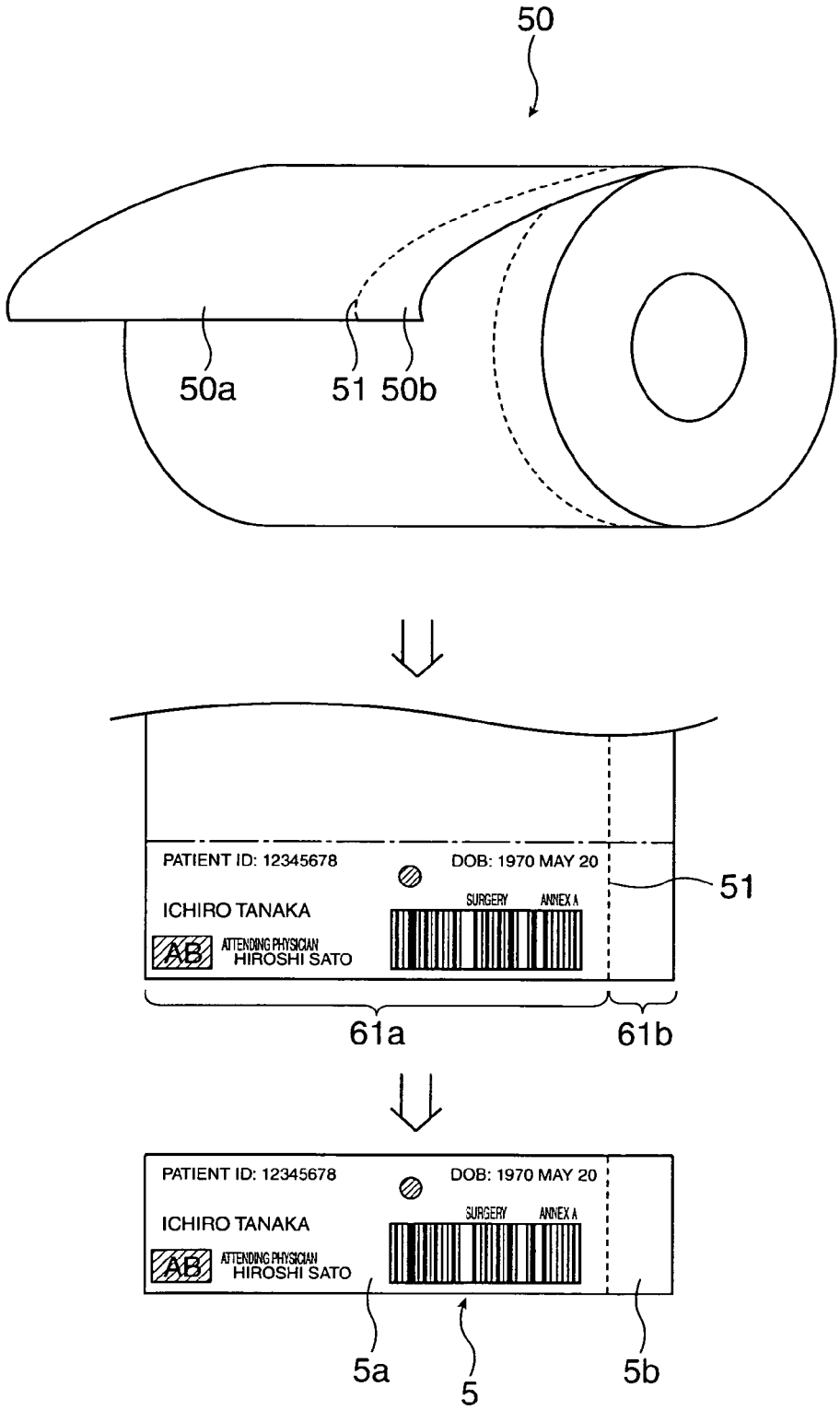
FIG. 4 shows an example of the roll paper used in the wristband tag production system according to the invention and a tag precursor produced by the invention.

As shown in FIG. 4, the roll paper 50 on which the patient identification information is printed is a paper tape wound onto a core. A perforation 51 running lengthwise from one end to the other end of the paper tape divides the paper widthwise into a first part 50*a* and a second part 50*b*. As described in further detail below, the first part 50*a* is the tag printing area 61*a* that becomes a printed tag part 5*a* of the tag precursor 5, and the second part 50*b* is the insertion tab area 61*b* that becomes an insertion tab part 5*b*. The perforation 51 thus divides the roll paper 50 widthwise into a tag printing area 61*a* that becomes the printed tag part 5*a* and an insertion tab area 61*b* that becomes the insertion tab part 5*b*.

The width of the tag printing area 61*a* corresponds to the size of the tag pocket 11 of the patient wristband 1, and the width of the insertion tab area 61*b* is only sufficient enough to enable being easily held by the fingers. The insertion tab part 5*b* of the tag precursor 5 can therefore be held with the tips of the fingers so that the printed tag part 5*a* can be easily inserted all the way into the tag pocket 11, and once the printed tag part 5*a* is fully inserted only the insertion tab area 61*b* sticks out from the insertion opening 21 to the tag pocket 11 as described in further detail below.

Figure 5:
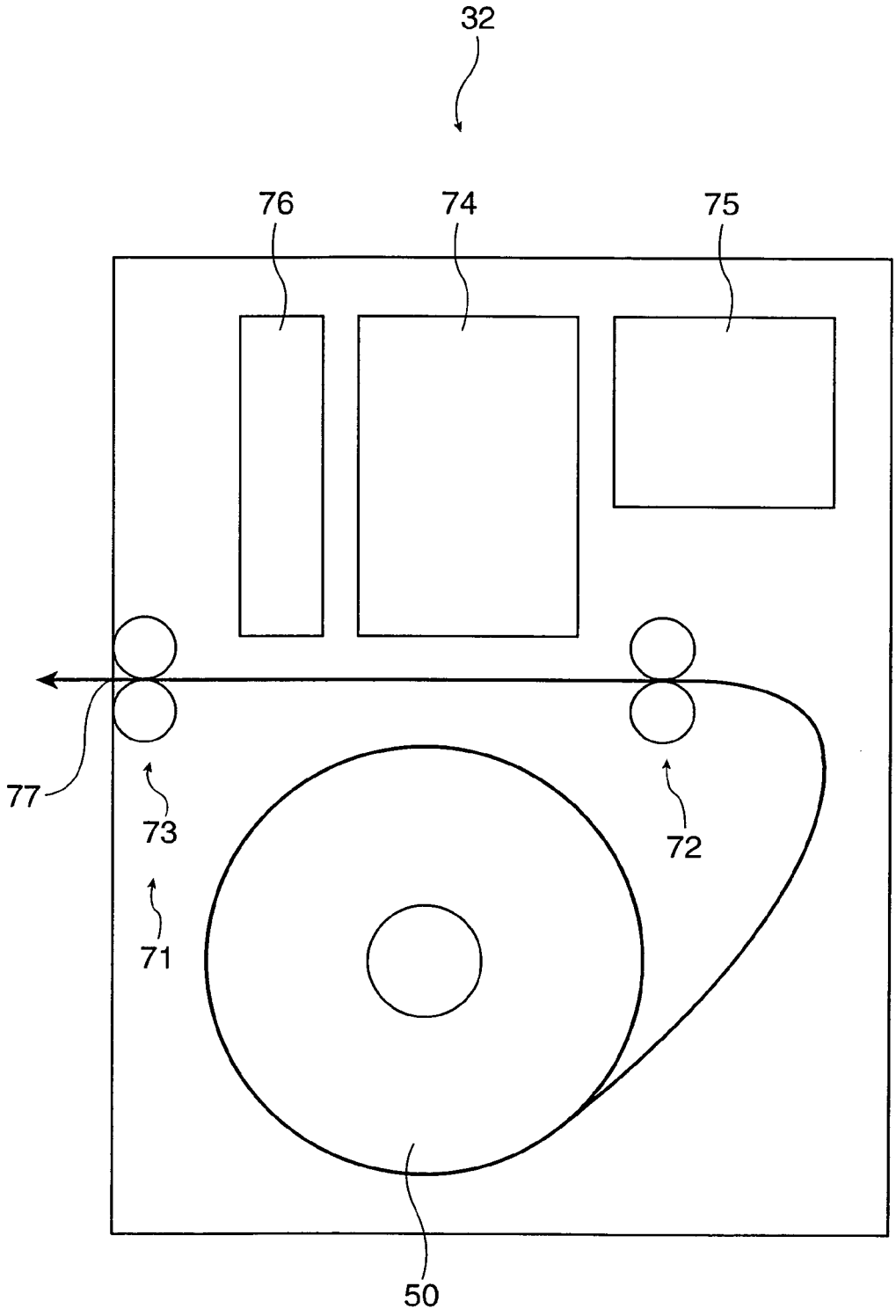
FIG. 5 is a schematic diagram of a printer rendering the wristband tag production system of the invention.

As shown in FIG. 5 the printer 32 in this aspect of the invention is a color inkjet printer composed of a paper feed unit 71, a printing unit 74, a printing control unit 75, and an automatic paper cutter 76.

The paper feed unit 71 holds the roll paper 50 so that paper can be delivered freely from the roll, and has supply rollers 72 and discharge rollers 73, which are grip rollers, for intermittently feeding the roll paper 50 in the subscanning direction toward the paper exit 77. The printing unit 74 has a plurality of inkjet heads (not shown in the figure) storing multiple colors of ink (black, cyan, yellow, and magenta in this aspect of the invention), and moves the inkjet heads by means of a carriage over the roll paper 50 in the main scanning direction while driving the inkjet heads to print to the roll paper 50. The printing control unit 75 includes ink cartridges for supplying the different colors of ink to the plural inkjet heads, a CPU, memory such as ROM or RAM, and a gate array, and controls the printing unit 74, interface 34, the automatic paper cutter 76, and other parts of the printer 32. The automatic paper cutter 76 is located between the printing unit 74 and the discharge rollers 73, and cuts the roll paper 50 widthwise to the paper. The printer 32 controls where the printing unit 74 prints across the width of the roll paper 50 by means of the printing control unit 75 controlling the movement of the inkjet head in the main scanning direction and the ink discharge timing.

The printing control unit 75 gets the patient identification information from the interface 34, controls the printing unit 74 to print the patient identification information in a predetermined direction at a predetermined position on the roll paper 50, and then drives the automatic paper cutter 76 to cut the paper. The printing control unit 75 controls all printer 32 operations.

The printer 32 prints the acquired patient identification information in the printed tag part 5*a* (first part 50*a*) of the roll paper 50 as shown in FIG. 4. After printing the patient identification information, the printed portion is advanced to the paper exit 77 side and the automatic paper cutter 76 cuts across the width of the paper at the trailing end of the printed portion. This produces the tag precursor 5 having a printed tag part 5*a* on which the patient identification information is printed and the insertion tab part 5*b* that is connected to the printed tag part 5*a* and can be easily separated from the printed tag part 5*a* by means of the perforation 51. The necessary number of tag precursors 5 can thus be easily and conveniently produced as needed.

Figure 6A:
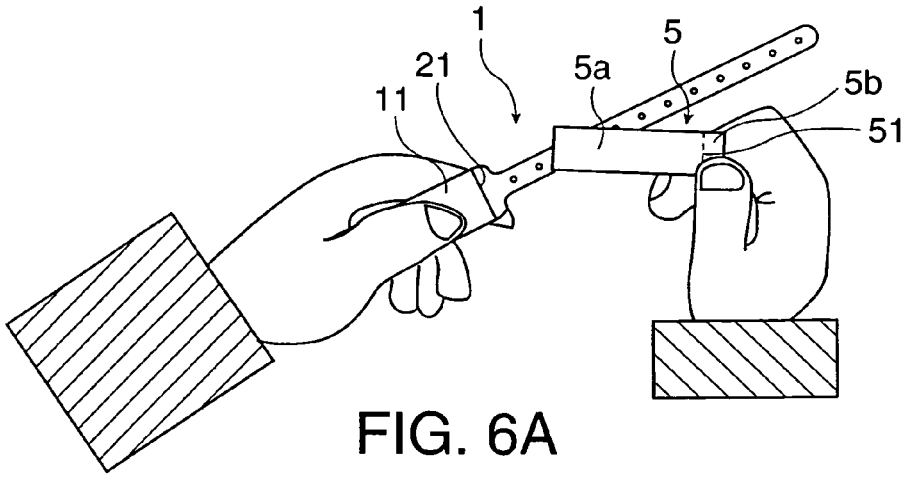
FIGS. 6A-6C describes the procedure for inserting and storing the printed tag part of the tag precursor in the tag pocket of the patient wristband.
Figure 6B:
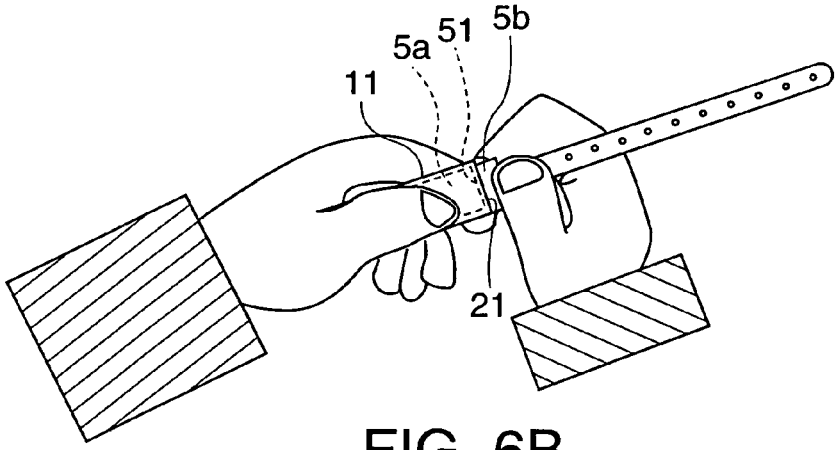

The printed tag precursor 5 is then inserted and stored in the tag pocket 11 of the patient wristband 1 as described below and shown in FIGS. 6A-6C. The nurse or other person holds the patient wristband 1 in their left hand, for example, with the insertion opening 21 (the back side of the wristband) facing up, holds the insertion tab part 5*b* of the tag precursor 5 with the right hand so that the printed side of the tag precursor 5 is facing away towards the top of the patient wristband 1, and inserts the printed tag part 5*a* from the insertion opening 21 into the tag pocket 11 (see FIG. 6A).

The printed tag part 5*a* is then inserted all they into the tag pocket 11. As described above this leaves the trailing end of the printed tag part 5*a*, that is, the perforation 51, inside of the insertion opening 21 to the tag pocket 11 with only the insertion tab part 5*b* sticking out from the insertion opening 21 (see FIG. 6B).

Figure 6C:
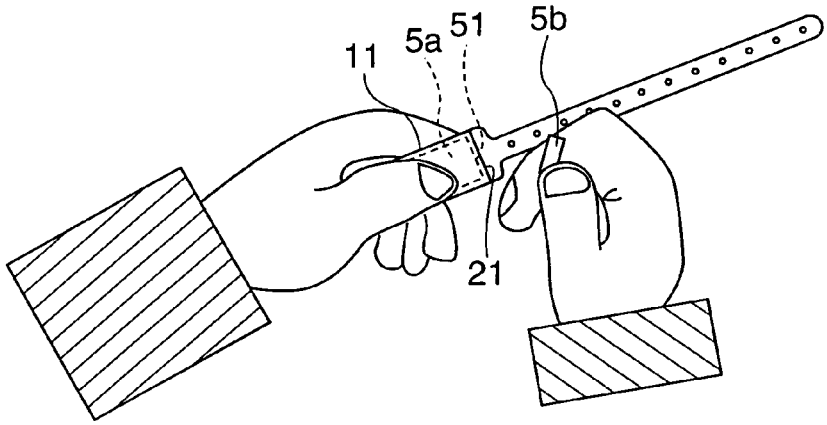

While firmly gripping the tag precursor 5 from both sides on the printed tag part 5*a* side of the perforation 51 with the left hand, the insertion tab part 5*b* is held with the right hand and torn off from the printed tag part 5*a* at the perforation 51 (see FIG. 6C). This leaves just the printed tag part 5*a* with the printed patient identification information inside the tag pocket 11 of the patient wristband 1.

The tag production system 31 of this aspect of the invention thus produces a tag precursor 5 that enables easily inserting the printed tag part 5*a* all the way into the tag pocket 11. More specifically, the tag production system 31 produces a tag precursor 5 having a printed tag part 5*a* and a insertion tab part 5*b*, the insertion tab part 5*b* can be held with the fingers to insert the printed tag part 5*a* into the tag pocket 11, and the printed tag part 5*a* can be easily inserted all the way into the tag pocket 11 without the fingertips holding the insertion tab part 5*b* catching on the insertion opening 21 to the tag pocket 11. After inserting the printed tag part 5*a*, the insertion tab part 5*b* is left exposed from the insertion opening 21 to the tag pocket 11 so that the insertion tab part 5*b* can be easily separated from the printed tag part 5*a* at the perforation 51, thus leaving the printed tag part 5*a* stored in the tag pocket 11 as an identification tag.

A second embodiment of the tag production system of the invention is described next. The arrangement of this second embodiment of a tag production system is substantially the same as the first embodiment and includes a printer 32 and data storage system 33. This embodiment differs in that adult patient tag precursors (first information tag precursors) for use with wristbands worn by adult patients, and child patient tag precursor (second information tag precursors) for use with wristbands worn by child patients, can be selectively produced. The second embodiment is described primarily with reference to this difference.

Figure 7A:
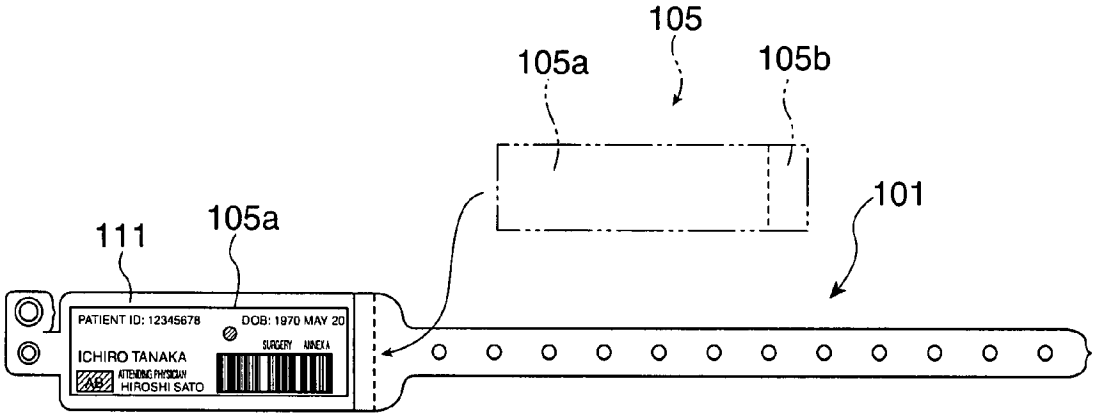
FIG. 7A shows an adult patient wristband and an adult tag precursor that is inserted to the tag pocket.
Figure 7B:
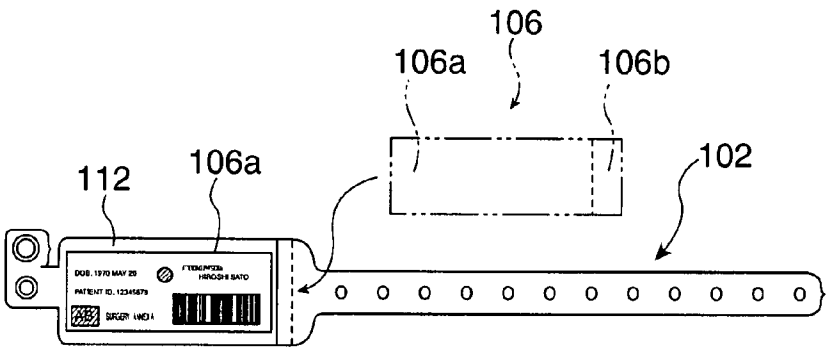
FIG. 7B shows a child patient wristband and a child tag precursor that is inserted to the tag pocket.

FIGS. 7A and 7B show examples of an adult patient wristband 101 and a child patient wristband 102. The adult patient wristband 101 and child patient wristband 102 are substantially the same as the patient wristband 1 described in the first embodiment except that as shown in FIGS. 7A and 7B the child patient wristband 102 is smaller than the adult patient wristband 101 due to the difference in wrist size.

As a result, the tag pocket 112 of the child patient wristband 102 is also smaller than the tag pocket 111 of the adult patient wristband 101. The child patient tag part 106*a* of the child patient tag precursor 106 that is stored in the tag pocket 112 of the child patient wristband 102 is therefore smaller and narrower than the adult patient tag part 105*a* of the adult patient tag precursor 105 that is stored in the tag pocket 111 of the adult patient wristband 101.

The data storage system 33 differentiates between adult patient identification information (first information) that is supplied to the printer 32 when the patient for whom a wristband is to be made is an adult and child patient identification information (second information) that is supplied to the printer 32 when the patient is a child. More specifically, the second PC terminal 42 determines the patient age from the date of birth information in the patient information acquired from the database 44, and determines if the patient age is greater than or equal to a predetermined age standard (such as 13 years). If the patient age is greater than or equal to the age standard, the second PC terminal 42 supplies the identification information as adult patient identification information, and supplies the identification information as child patient identification information if the patient age is less than the age standard. Whether the patient is an adult or a child could, of course, be directly declared in the patient information when the patient information is entered at the first PC terminal 41, and the second PC terminal 42 could reference this adult/child flag to differentiate between adult patient identification information and child patient identification information.

Figure 8:
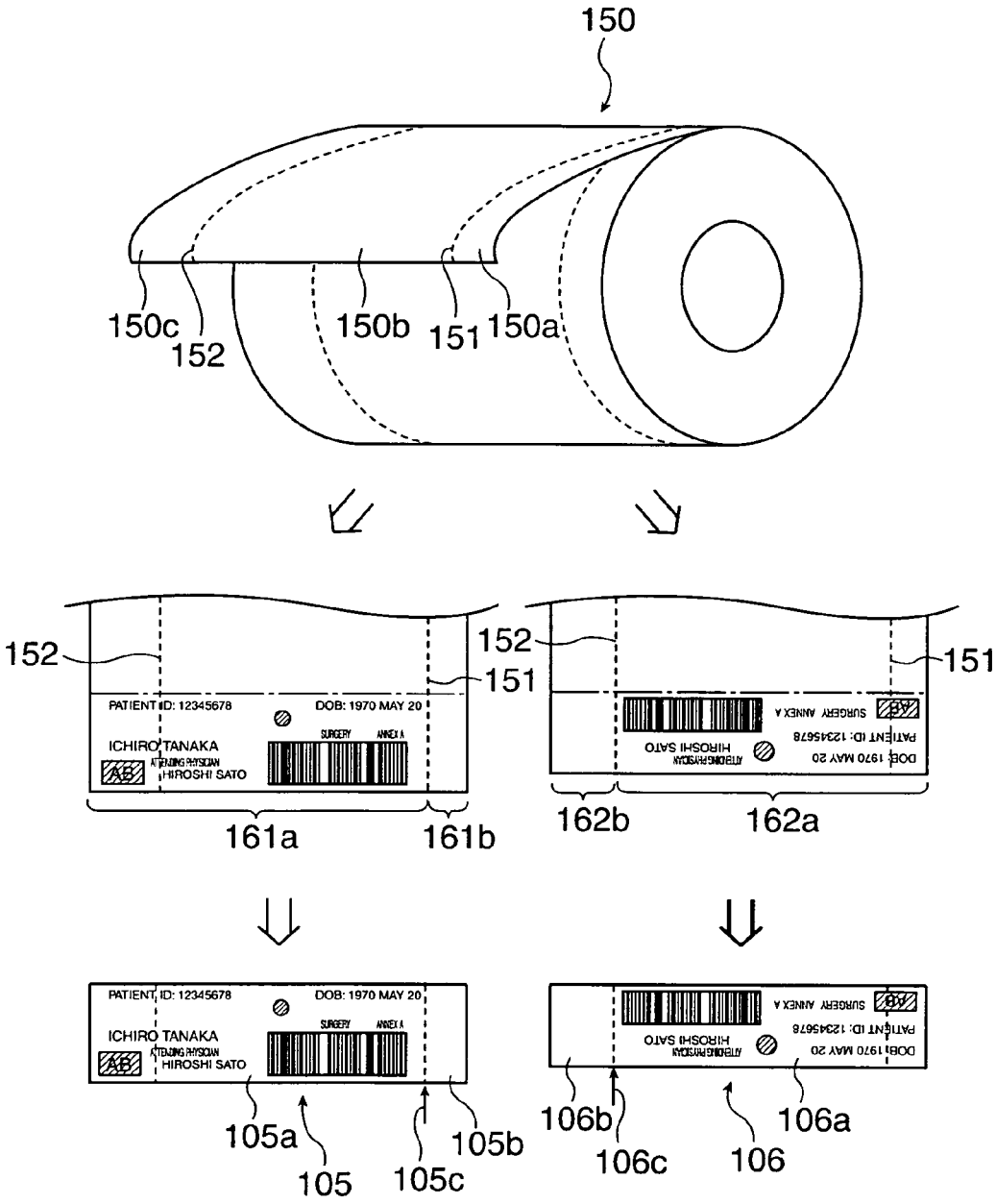
FIG. 8 shows the roll paper used in a patient wristband tag production system according to another aspect of the invention and an adult patient tag precursor and child patient tag precursor produced from this roll paper.

FIG. 8 shows the roll paper 150 used in the tag production system 31 according to this second embodiment of the invention. As shown in the figure the roll paper 150 used in this embodiment has a first perforation 151 and a second perforation 152 both running along the entire length of the paper. The first perforation 151 and second perforation 152 are spaced to divide the paper width into a narrow first part 150*a*, a wide second part 150*b*, and a third part 150*c* of an intermediate width.

As described more fully below the second part 150*b* and third part 150*c* render a first tag printing area 161*a* that becomes the adult patient tag part 105*a* of an adult patient tag precursor 105, and the first part 150*a* renders a first insertion tab area 161*b* that becomes the insertion tab part 105*b* of the adult patient tag precursor 105. Similarly, the first part 150*a* and second part 150*b* render a second tag printing area 162*a* that becomes the child patient tag part 106*a* of a child patient tag precursor 106, and the third part 150*c* renders a second insertion tab area 162*b* that becomes the insertion tab part 106*b* of the child patient tag precursor 106.

The first perforation 151 thus divides the full width of the roll paper 150 into a first tag printing area 161*a* that becomes the adult patient tag part 105*a* of an adult patient tag precursor 105 and the first insertion tab area 161*b* that becomes the insertion tab part 105*b* of the adult patient tag precursor 105, and the second perforation 152 divides the full width of the roll paper 150 into a second tag printing area 162*a* that becomes the child patient tag part 106*a* of a child patient tag precursor 106 and a second insertion tab area 162*b* that becomes the insertion tab part 106*b* of the child patient tag precursor 106. The first tag printing area 161*a* and second tag printing area 162*a* are also shifted widthwise to the paper to render tag precursors of different lengths.

The width of the first tag printing area 161*a* corresponds to the size of the tag pocket 111 of the adult patient wristband 101, and the first insertion tab area 161*b* is just wide enough to be easily grasped with the fingers. The width of the second tag printing area 162*a* is sized to match the tag pocket 112 of the child patient wristband 102, and the second insertion tab area 162*b* is wide enough to be easily grasped with the fingers. The size of the first tag printing area 161*a* across the width of the paper is also different from the size of the second tag printing area 162*a* with the second tag printing area 162*a* being smaller.

When adult patient identification information is supplied from the data storage system 33, the printer 32 prints the adult patient identification information in the first tag printing area 161*a* of the roll paper 150. When child patient identification information is supplied, the printer 32 prints the child patient identification information in the second tag printing area 162*a* of the roll paper 150 while also rotating the child patient identification information approximately 180 degrees to the printed adult patient identification information.

The automatic paper cutter 76 then cuts the trailing end of the printed portion across the paper width. As a result, adult patient tag precursors 105 having an adult patient tag part 105*a* where the adult patient identification information is printed and an insertion tab part 105*b* that is connected to and can be easily separated from the adult patient tag part 105*a* by the first perforation 151, and child patient tag precursors 106 having a child patient tag part 106*a* where the child patient identification information is printed and a insertion tab part 106*b* that is connected to and can be easily separated from the child patient tag part 106*a* by the second perforation 152, can be selectively produced from the same paper stock. Note that arrow 105*c* in FIG. 8 points to where the tab is separated from the tag of the adult patient tag precursor 105, and arrow 106*c* points to where the tab is separated from the tag of the child patient tag precursor 106.

This embodiment of the invention thus enables selectively producing both adult patient tag precursors 105 and child patient tag precursors 106 from the same roll paper 150. More specifically, this aspect of the invention eliminates the need to use one type of roll paper to make adult patient tag precursors 105 and another type of roll paper to make child patient tag precursors 106.

In this case the adult patient identification information is printed across the second perforation 152 in the second part 150*b* and third part 150*c*, and the child patient identification information is printed across the first perforation 151 in the first part 150*a* and second part 150*b*.

If the first tag printing area 161*a* and second tag printing area 162*a* are located on the same side of the paper width as described in another variation below, the adult patient identification information is printed on both sides of the second perforation 152 in the second part 150*b* and third part 150*c* and the child patient identification information is printed on one side of the second perforation 152 in only the third part 150*c*.

If the width of the second tag printing area 162*a* is greater than half the full width of the roll paper 150, the gap between the first perforation 151 and second perforation 152 is greater than when the first tag printing area 161*a* and second tag printing area 162*a* are on the same side of the paper width. As a result, the printed tag part 105*a*, 106*a* will not be accidentally torn in two at the other perforation 152, 151 when the insertion tab part 105*b*, 106*b* is separated at one perforation 151, 152 after inserting the printed tag part 105*a*, 106*a* to the tag pocket 111, 112.

Furthermore, by rotating the child patient identification information approximately 180 degrees to the adult patient identification information, the printed tag parts 105*a*, 106*a* of the adult patient tag precursor 105 and child patient tag precursor 106 can be held by respective insertion tab parts 105*b*, 106*b* for insertion to the tag pocket 111, 112 without the adult patient identification information and child patient identification information being inverted in the pocket.

Figure 9:
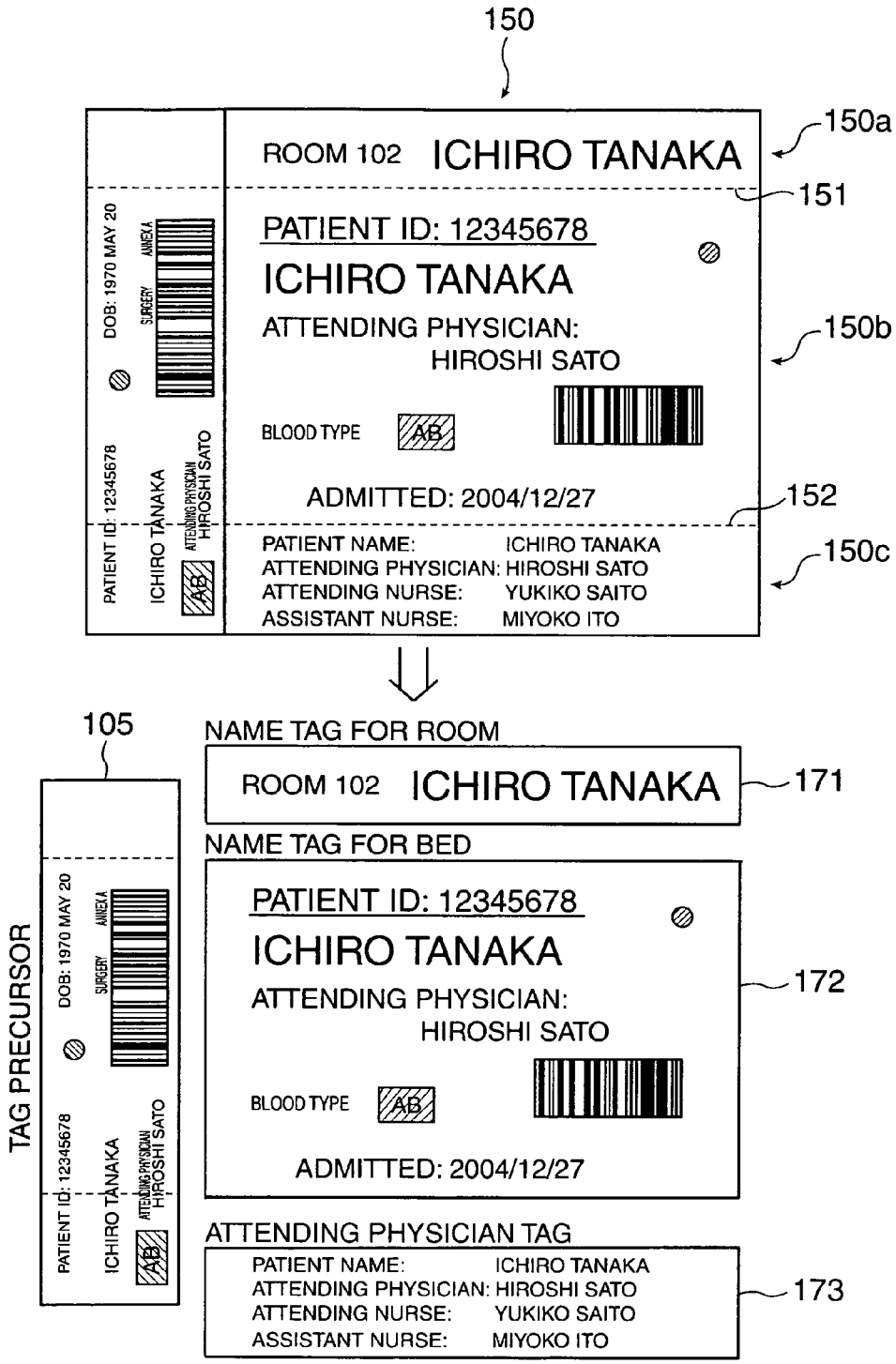
FIG. 9 shows a variety of other small tags and labels that can be printed using the perforations of the roll paper used in a patient wristband tag production system according to another aspect of the invention.

As shown in FIG. 9 the roll paper 150 in this embodiment of the invention can also be used to produce printed matter other than tag precursors 105 and 106. More specifically, when a patient enters the hospital, a room name label 171, a bed name label 172, and an attending physician label 173 may also be printed in addition to the tag precursor 105, 106 for the patient wristband 101, 102.

Each of these other labels are of different sizes. However, the first perforation 151 and second perforation 152 in the roll paper 150 of this embodiment can be used to produce printed matter of three different sizes including large (second part 150*b*), medium (third part 150*c*), and small (first part 150*a*). The first part 150*a* could be used, for example, to produce the room name label 171, the second part 150*b* to produce the bed name label 172, and the third part 150*c* to produce the attending physician label 173. Small printed matter of plural different sizes can thus be produced without using different types of print media and without changing and loading different print media to produce the different items.

Figure 10:
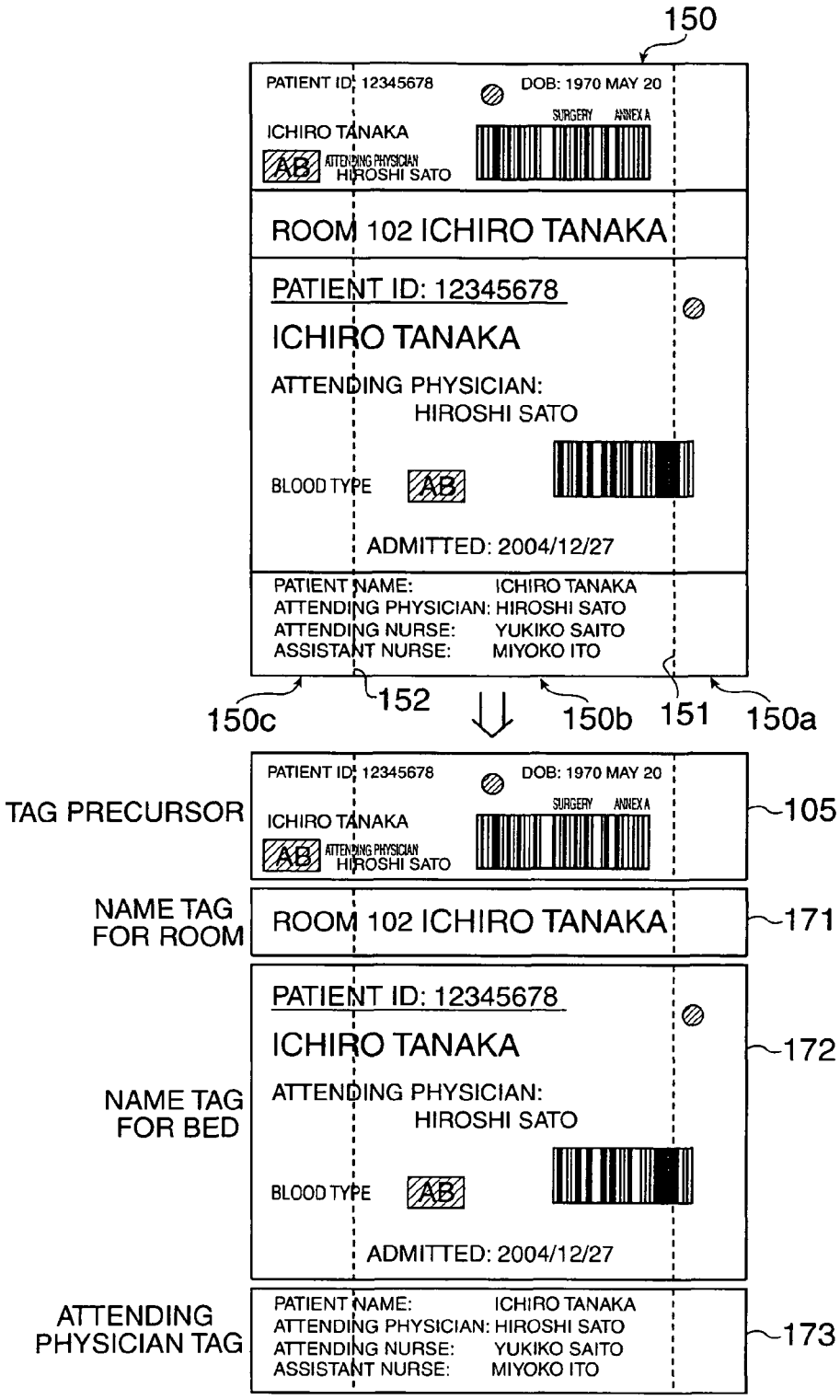
FIG. 10 shows examples of printed matter produced while ignoring the perforations in the roll paper used in a patient wristband tag production system according to another aspect of the invention.

If the size of room name label 171 or other printed matter does not match the widths of the different parts 150*a*, 150*b*, 150*c* rendered by perforations 151 and 152 running lengthwise to the roll paper 150, the perforations 151, 152 can also be ignored and the roll paper 150 used as plain roll paper to print the room name label 171, bed name label 172, and attending physician label 173 as desired, as shown in FIG. 10.

Though not shown in the figures, it will also be obvious that the perforation 51 in the roll paper 50 used in the first embodiment can also be used or appropriately ignored to produce printed matter other than the tag precursor 5.

Figure 11:
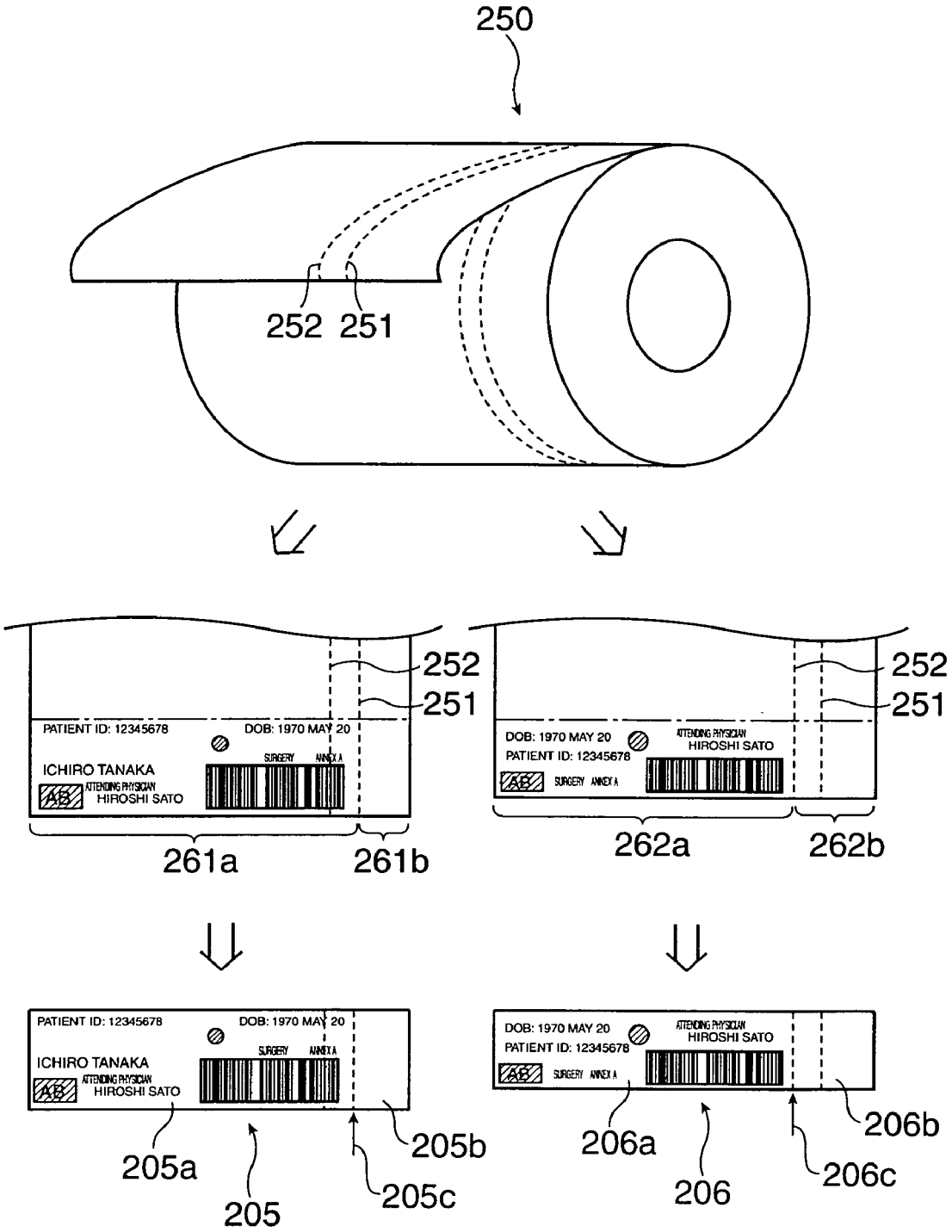
FIG. 11 shows a variation of the roll paper used in a patient wristband tag production system according to another aspect of the invention and samples of the adult patient tag precursor and child patient tag precursor produced from this roll paper.

FIG. 11 shows a variation of the roll paper used in the second embodiment. Similarly to the roll paper 150 described above, a first perforation 251 divides the width of this roll paper 250 into a first printed tag area 261*a* that becomes the printed tag part 205*a* of an adult tag precursor 205 and a first insertion tab area 261*b* that becomes the insertion tab part 205*b* of the adult tag precursor 205, and a second perforation 252 divides the width of the paper into a second printed tag area 262*a* (that is shorter than the first printed tag area 261*a*) that becomes the printed tag part 206*a* of a child tag precursor 206 and a second insertion tab area 262*b* that becomes the insertion tab part 206*b* of the child tag precursor 206. This roll paper 250 differs from the roll paper 150 described above in that the first printed tag area 261*a* and second printed tag area 262*a* are offset towards the same long edge of the paper (to the same side across the width of the paper).

When adult patient identification information is supplied, the printer 32 prints the adult patient identification information in the first printed tag area 261*a* of the roll paper 250. When child patient identification information is supplied, the printer 32 prints the child patient identification information in the second printed tag area 262*a* of the roll paper 250. As a result, the printer 32 can selectively produce both adult tag precursors 205 and child tag precursors 206 from the same paper stock. In this case the child patient identification information is printed in the same orientation as the adult patient identification information. Note that arrow 205*c* in the figure indicates where the tab is removed to produce adult tag precursors 205, and arrow 206*c* indicates where the tab is removed to produce child tag precursors 206.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A patient wristband tag production apparatus for printing and producing a tag precursor, the patient wristband tag production apparatus comprising:

a printing unit;

a print medium web having a perforation running a length of the web and dividing the web into a first area and a second area, the print-medium web being configured to produce tag precursors, an information acquisition unit for acquiring patient identification information;

a printing control unit for printing the acquired patient identification information while advancing the print medium web, the printing control unit having a first mode of operation and a second mode of operation; and a cutter for cutting across the print medium web width to sever the portion of the print medium web printed by the printing unit as the tag precursor, wherein the printing control unit is configured to print at least a portion of acquired patient identification information in the first area in the first mode of operation such that the first area is a first tag printing area and the second area is a first insertion tab area;

wherein the printing control unit is configured print at least a portion of acquired patient identification information in the second area in the second mode of operation such that the second area is a second tag printing area and the first area is a second insertion tab area, patient identification information printed, in the first tag printing area being oriented approximately 180 degrees relative to patient identification information printed in the second tag printing area; and wherein the first and second tag printing areas of the tag precursors produced from the print medium web are first and second printed tag parts, respectively, on which patient identification information is printed and the first and second insertion tab areas of the tag precursors produced from the print medium web are first and second insertion tab parts, respectively, that are detachably connected to the respective first and second tag parts and are configured to be used for inserting the respective first and second printed tag parts into tag storage parts of a patient wristband.

2. A patient wristband tag production system comprising:

the patient wristband tag production apparatus described in any of claim 1; and an information supplying means that is linked to the patient wristband tag production apparatus and supplies the patient information to the information acquisition unit.

3. A patient wristband tag production apparatus for printing and producing a first information tag precursor and a second information tag precursor, the patient wristband tag production apparatus comprising:

a printing unit;

a print medium web having a first perforation running a length of the web and dividing the web into a first tag printing area and a first insertion tab area and a second perforation running a length of the web and dividing the Web into a second tag printing area and a second insertion tab area, the print medium web being configured to produce first and second tag precursors, an information acquisition unit for acquiring information to be provided on the first information tag precursors and information to be provided on the second information tag precursors;

a printing control unit for printing in a first mode in which the information to be provided on the first information tag precursors in the first tag printing area is printed and printing in a second mode in which the information to be provided on the second information tag precursors in the second tag printing area is printed, the printing occurring while advancing the print medium web and the information to be provided on the first information tag precursor being oriented approximately 180 degrees relative to the information to be provided on the second information tag precursor; and a cutter for cutting across the print medium web width to sever the portion of the print medium web printed by the printing unit as the first information tag precursor or the second information tag precursor, wherein the first tag precursors produced from the print medium web have a first printed tag part formed from the first tag printing area on which patient information is printed such that the first tag precursor is configured to be stored in a tag storage part of a patient wristband, and a first insertion tab part formed from the first insertion tab area that is detachably connected to the first printed tag part and is configured to be used for inserting the first printed tag part into a tag storage part, and wherein the second tag precursors produced from the print medium web have a second printed tag part formed from the second tag printing area on which patient information is printed such that the second tag precursor is configured to be stored in a tag storage part, and, a second insertion tab part formed from the second insertion tab area that is detachably connected to the second printed tag part and is configured to be used for inserting the second printed tag part into a tag storage part.

4. The patient wristband tag production apparatus described in claim 3, wherein the printing control unit prints the first tag printing area and the second tag printing area offset to different sides of the print medium web width.

5. The patient wristband tag production apparatus described in any of claim 3, wherein the size of the first tag printing area is different from the size of the second tag printing area across the print medium web width.

6. The patient wristband tag production apparatus described in any of claim 3, wherein the first printed tag part of the first information tag precursor includes patient information for adult patients and the second printed tag part of the second information tag precursor includes patient information for child patients.

7. The patient wristband tag production apparatus described in claim 3, wherein a width of the second tag printing area is greater than half of a width of the print medium web.

8. The patient wristband tag production apparatus described in claim 3, wherein the information to be provided on the first information tag precursors is patient identification information and the information to be provided on the second information tag precursors is other printed information.

9. The patient wristband tag production apparatus described in claim 8, wherein said other printed information includes at least one of a room name, a bed name, and an attending physician.

10. The patient wristband tag production apparatus described in claim 8, wherein said other printed information extends across said first and second perforations.

11. The patient wristband tag production apparatus described in claim 3, wherein said first tag printing area extends across said second perforation and said second tag printing area extends across said first perforation.

12. The patient wristband tag production apparatus described in claim 3, wherein said first insertion tab and said second insertion tab are disposed on a same side of said print medium web.

13. A patient wristband tag production system for producing a tag precursor configured to be inserted into a patient wristband, the patient wristband tag production system comprising:

a patient wristband having a tag storage part; and an apparatus for printing and producing a tag precursor, the apparatus including:

a printing unit;

a print medium web having a perforation running a length of the web and dividing the web into a first area and a second area, the print medium web being configured to produce tag precursors;

an information acquisition unit for acquiring patient identification information;

a printing control unit for printing the acquired patient identification information while advancing the print medium web, the printing control unit having a first mode of operation and a second mode of operation; and a cutter for cutting across the print medium web width to sever the portion of the print medium web printed by the printing unit as the tag precursors;

wherein the printing control unit is configured to print at least a portion of acquired patient identification information in the first area in the first mode of operation such that the first area is a first tag printing area and the second area is a first insertion tab area;

wherein the printing control unit is configured to print at least a portion of acquired patient identification information in the second area in the second mode of operation such that the second area is a second tag printing area and the first area is a second insertion tab area, the patient identification information printed in the first tag printing area being oriented approximately 180 degrees relative to the patient identification information printed in the second tag printing area; and wherein the first and second tag printing areas of the tag precursors produced from the print medium web are first and second printed tag parts, respectively, on which patient identification information is printed and the first and second insertion tab areas of the tag precursors produced from the print medium web are first and second insertion tab parts, respectively, that are detachably connected to the respective first and second printed tag parts and are configured to be used for inserting the respective first and second printed tag parts into tag storage parts of a patient wristband.

14. The patient wristband tag production system of claim 13, wherein:

the perforation running a length of the web is a first perforation, the first area being the first tag printing area, and the second area being the first insertion tab area, the print medium web further comprising:

a second perforation running a length of the web and dividing the web into a third area and a fourth area, the third area being the second tag printing area, the fourth area being the second insertion tab area, and the print medium web being configured to produce a first tag precursor including the first tag printing area and the first insertion tab area and a second tag precursor including the second tag printing area and the second insertion tab area;

the patient identification information acquired by the information acquisition unit comprises information to be provided on the first tag precursors and information to be provided on the second tag precursors;

the printing control unit is configured to print the information to be provided on the first tag precursors in the first tag printing area in the first mode and print the information to be provided on the second information tag precursors in the second tag printing area in the second mode, the information to be provided on the first tag precursor being approximately 180 degrees to the information to be provided on the second tag precursor;

the portion of the print medium web printed by the printing unit as the tag precursors that the cutter is configured to sever includes the first tag precursor and the second tag precursor;

the first printing area of the first tag precursor produced from the print medium web is the first printed tag part on which first patient identification information is printed such that the first tag precursor is configured to be stored in the tag storage part of the patient wristband, and the first insertion tab area of the second tag precursor produced from the print medium web is the first insertion tab part that is detachably connected to the first printed tag part and is configured to be used for inserting the first printed tag part into a tag storage part; and the second printing area of the second tag precursor produced from the print medium web is the second printed tag part on which second patient identification information is printed such that the second tag precursor is configured to be stored in a tag storage part and the second insertion tab area of the second tag precursor produced from the print medium web is the second insertion tab part that is detachably connected to the second printed tag part and is configured to be used for inserting the second printed tag part into a tag storage part.

15. A patient tag precursor production apparatus for printing and producing multiple tag precursors, the patient tag precursor production apparatus comprising:

a printing unit for printing on a print medium web multiple tag precursors, wherein a first tag precursor of the multiple tag precursors has a first printed tag part on which patient identification information is printed and is configured to be stored in a first tag storage part, and a first insertion tab part that is detachably connected to the first printed tag part and is configured to be used for inserting the first printed tag part into the first tag storage part, and a second tag precursor of the multiple tag precursors has a second printed tag part on which patient information is printed;

an information acquisition unit for acquiring patient information;

a printing control unit for printing in a first mode in which at least a portion of the acquired patient information is printed on the first printed tag part and for printing in a second mode in which at least a portion of the acquired patient information is printed on the second printed tag part, the printing occurring while advancing the print medium web, the acquired patient information printed on the first printed tag part being oriented either approximately 180 degrees relative to the portion of the acquired patient information printed on the second printed tag part or approximately 90 degrees relative to the acquired patient information printed on the second printed tag part; and a cutter for cutting across the print medium web width to sever the portion of the print medium web printed by the printing unit as the multiple tag precursors.

16. The patient tag precursor production apparatus of claim 15, wherein the printing control unit prints the first printed tag part and the second printed tag part offset to different sides of the print medium web width.

17. The patient tag precursor production apparatus of claim 15, wherein the printing control unit is configured to print the first and second printed tag parts such that the size of the first printed tag part is different from the size of the second printed tag part across the print medium width.

18. The patient tag precursor production apparatus of claim 15, wherein the printing control unit is configured such that the patient information printed in the first mode includes patient information for adult patients and the patient information printed in the second mode includes patient information for child patients.

19. A patient tag production system, comprising:

the patient tag precursor production apparatus described in claim 15; and an information supplying unit that is linked to the patient tag precursor production apparatus and supplies the patient information to the information acquisition unit.

20. The patient tag precursor production apparatus of claim 15, further comprising:

a print medium web having a first perforation running a length of the web and dividing the web into a first area and a second area, the first area including the first printed tag part and the second area including the first insertion tab part when the printing unit is operated in the first mode and the second area including the second printed tag part when the printing unit is operated in the second mode.

21. The patient tag precursor production-apparatus of claim 15, further comprising:

a print medium web having a first perforation running a length of the web and a second perforation running a length of the web, dividing the web into a first area, a second area, and a third area.

22. The, patient tag precursor production apparatus of claim 21, wherein a width of the second area is greater than half of a width of the print medium web.

23. The patient tag precursor production apparatus of claim 21, wherein the first printed tag part includes the first area and the second area and the first insertion tab part includes the third area when the printing unit is operated in the first mode.

24. The patient tag precursor production apparatus of claim 23, wherein the second printed tag part includes the second area and the third area when the printing unit is operated in the second mode.

25. The patient tag precursor production apparatus of claim 23, wherein the second printed tag part includes at least one of the first area, the second area, and the third area, and the patient information printed on the first printed tag part is approximately 90 degrees to the portion of the patient information printed on the second tag part.

26. The patient tag precursor production apparatus of claim 15, wherein the information to be provided on the first printed tag part is patient identification information and the information to be provided on the second information tag precursor is other printed information.

27. The patient tag precursor production apparatus of claim 26, wherein the other printed information includes at least one of a room name, a bed name, and an attending physician.

28. The patient tag precursor production apparatus of claim 15, wherein the printing control unit is configured to print the first printed tag part across a second perforation of a print medium web and to print the second printed tag part across a first perforation of the print medium web.

29. The patient tag precursor production apparatus of claim 15, wherein the printing control unit is configured to print the first printed tag part across a perforation of a print medium web and to print the second printed tag part without going across the perforation of a print medium web.

30. The patient tag precursor production apparatus of claim 15, wherein the printing control unit is configured to print the first printed tag part across a first perforation of a print medium web and to print the second printed tag part in a section defined by one of: (1) a first edge of the print medium web and the first perforation; (2) the first perforation and a second perforation of the print medium web; (3) and the second perforation and a second edge of the print medium web.

31. The patient tag precursor product ion apparatus of claim 30, wherein, the printing control unit is configured to print a third printed tag part in one of the other portions in which the second printed tag part is not printed of: (1) the first edge of the print medium web and the first perforation; (2) the first perforation and the second perforation of the print medium web; (3) and the second perforation and the second edge of the print medium web.

32. The patient tag precursor production apparatus of claim 31, wherein the printing control unit is configured to print a fourth printed tag part in the remaining portion in which the second printed tag part and the third printed tag part is not printed of: (1) the first edge of the print medium web and the first perforation; (2) the first perforation and the second perforation of the print medium web; (3) and the second perforation and the second edge of the print medium web.

33. The patient tag precursor production apparatus of claim 15, wherein the second tag precursor of the multiple tag precursors has a second insertion tab part that is detachably connected to the second printed tag part and is configured to be used for inserting the second printed tag part into a second tag storage part.

* * * * *